US009893439B2

(12) United States Patent
Washio et al.

(10) Patent No.: US 9,893,439 B2
(45) Date of Patent: Feb. 13, 2018

(54) TERMINAL FITTING WITH WIRE CONNECTION PORTION

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuhiro Washio, Mie (JP); Yasuo Omori, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/515,000

(22) PCT Filed: Oct. 15, 2015

(86) PCT No.: PCT/JP2015/079107
§ 371 (c)(1),
(2) Date: Mar. 28, 2017

(87) PCT Pub. No.: WO2016/072232
PCT Pub. Date: May 12, 2016

(65) Prior Publication Data

US 2017/0214156 A1 Jul. 27, 2017

(30) Foreign Application Priority Data

Nov. 5, 2014 (JP) ..... 2014-224949

(51) Int. Cl.
*H01R 4/10* (2006.01)
*H01R 11/11* (2006.01)
(Continued)

(52) U.S. Cl.
CPC ..... *H01R 11/11* (2013.01); *H01R 4/06* (2013.01); *H01R 4/48* (2013.01); *H01R 11/12* (2013.01);
(Continued)

(58) Field of Classification Search
USPC ..... 439/879, 891
See application file for complete search history.

(56) References Cited

U.S. PATENT DOCUMENTS 5,399,110 A * 3/1995 Morello ..... H01R 4/185 439/879
6,290,556 B1 * 9/2001 Howland ..... H01R 4/188 439/879
(Continued)

FOREIGN PATENT DOCUMENTS

JP 63-146969 9/1988
JP 2004-206965 7/2004
(Continued)

OTHER PUBLICATIONS

International Search Report dated Nov. 24, 2015.

*Primary Examiner* — Tho D Ta
(74) *Attorney, Agent, or Firm* — Gerald E. Hespos; Michael J. Porco; Matthew T. Hespos

(57) ABSTRACT

It is aimed to provide a terminal fitting capable of preventing a large force from acting on joint portions of a wire connecting portion and another constituent component formed separately from the wire connecting portion. The terminal fitting includes a wire connecting portion (10) to be connected to an end part of a wire (30) and another con-
(Continued)

stituent component (20) formed separately from the wire connecting portion (10) and to be arranged in front of the wire connecting portion (10). The other constituent component (20) includes a joint piece (24) to be overlapped on the wire connecting portion (10) and joined. A part of the wire connecting portion (10) behind a part to be crimped to a core (31) of the wire (30) is joined to the joint piece (24).

4 Claims, 8 Drawing Sheets

(51) Int. Cl.

| | |
|---|---|
| ***H01R 11/12*** | (2006.01) |
| ***H01R 4/06*** | (2006.01) |
| ***H01R 4/48*** | (2006.01) |
| *H01R 13/04* | (2006.01) |
| *H01R 13/10* | (2006.01) |
| *H01R 4/18* | (2006.01) |
| *H01R 4/02* | (2006.01) |

(52) U.S. Cl.
CPC ..... *H01R 4/023* (2013.01); *H01R 4/185* (2013.01); *H01R 13/04* (2013.01); *H01R 13/10* (2013.01)

(56) References Cited

U.S. PATENT DOCUMENTS

| | | | | |
|---|---|---|---|---|
| 7,252,558 | B2 * | 8/2007 | Cottle | H01R 11/24 439/504 |
| 7,494,388 | B2 * | 2/2009 | Kakuta | H01R 4/185 439/877 |
| 7,896,715 | B2 * | 3/2011 | Kumakura | H01R 4/185 439/442 |
| 8,540,535 | B2 * | 9/2013 | Martens | H01R 4/00 439/866 |
| 2013/0078874 | A1 | 3/2013 | Itou et al. | |
| 2013/0231013 | A1 | 9/2013 | Sato et al. | |
| 2015/0064991 | A1 | 3/2015 | Kawamura et al. | |
| 2015/0079825 | A1 | 3/2015 | Miyamoto et al. | |

FOREIGN PATENT DOCUMENTS

| | | |
|---|---|---|
| JP | 2012-84267 | 4/2012 |
| JP | 2013-84505 | 5/2013 |
| WO | 2013/137429 | 9/2013 |
| WO | 2014024938 | 2/2014 |

* cited by examiner

TERMINAL FITTING WITH WIRE CONNECTION PORTION

BACKGROUND

1. Field of the Invention

The present invention relates to a terminal fitting.

2. Description of the Related Art

A known technique forms a wire connecting portion to be connected to an end part of a wire, separately forms a part to be arranged in front of the wire connecting portion and then joins those as separately formed components. For example, Japanese Unexamined Patent Publication No. 2013-84505 discloses a terminal fitting described with a wire connecting portion to be connected to an end part of a wire. A rectangular tube that is to be arranged in front of the wire connecting portion is formed as a separate component for the purpose of reducing cost. The wire connecting portion is integrally formed with a resilient contact piece to be arranged inside the rectangular tube and is configured to resiliently contact a mating terminal fitting. The wire connecting portion including the resilient contact piece is made of copper alloy that is excellent in conductivity. However, the rectangular tube is made of relatively inexpensive stainless steel, thereby reducing material cost for the terminal fitting. The wire connecting portion and the rectangular tube are held in an assembled state by holding a holding piece provided on a rear end part of the rectangular tube in close contact with a part between the resilient contact piece and the wire connecting portion.

A large force tends to act on joint portions of the wire connecting portion and another constituent component in the terminal fitting as described above if the wire connected to a mating side vibrates. Thus, a countermeasure has been desired.

The present invention was completed based on the above situation and aims to provide a terminal fitting capable of preventing a large force from acting on joint portions of a wire connecting portion and another constituent component formed separately from the wire connecting portion.

SUMMARY

The invention is directed to a terminal fitting with a wire connecting portion to be connected to an end part of a wire, and another constituent component formed separately from the wire connecting portion and to be arranged in front of the wire connecting portion. The other constituent component includes a joint piece to be overlapped on the wire connecting portion and joined, and a part of the wire connecting portion behind a part to be crimped to a core of the wire is joined to the joint piece.

The wire connecting portion may include a barrel to be crimped to the end part of the wire, and the wire connecting portion may have a part to be joined to the joint piece and projecting rearwardly of the barrel. According to this configuration, the joint portions of the wire connecting portion and the other constituent component are displaced rearward of the barrel. Thus, the influence of the deformation of the barrel on the joint portions when the barrel portion is crimped can be reduced.

The barrel may be crimped to the end part of the wire arranged on an upper surface, and the joint piece is overlapped on an upper side of a bottom portion of the barrel and joined. According to this configuration, the barrel is crimped to the joint piece together with the wire. Thus, a force acting on the joint portions can be reduced further.

The wire connecting portion and the other constituent component may be joined by welding. According to this configuration, the structures of the joints can be simplified, for example, as compared to the case where joints provided with crimping pieces are joined.

The other constituent component may include a connecting body having a bolt insertion hole for bolting to a ground part. According to this configuration, in the terminal fitting bolted to the ground part, the joints of the wire connecting portion and the other constituent component are arranged on the ground part side. The wire is hardly bent toward the ground part side (joint portion side). Thus, a force acting on the joint portions can be reduced.

According to the present invention, since the joint portions of the wire connecting portion and the other constituent component formed separately from the wire connecting portion are arranged along the wire, the joint portions vibrate together with the wire. Thus, it is possible to prevent a large force from acting on the joint portions of the wire connecting portion and the other constituent component.

DETAILED DESCRIPTION

Hereinafter, one specific embodiment of the invention is described in detail with reference to FIGS. 1 to 8.

Figure 1:
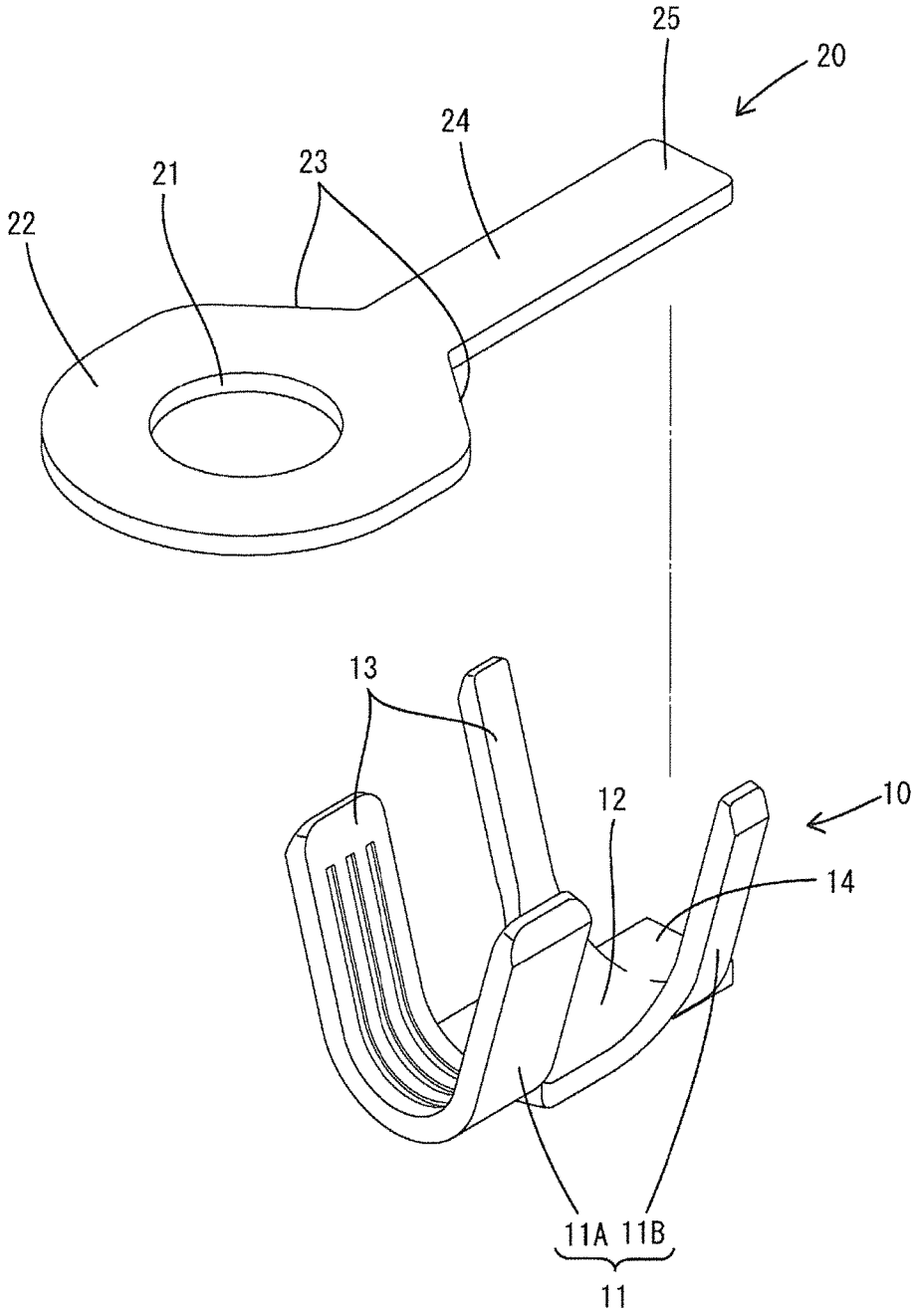
FIG. 1 is a perspective view of a terminal fitting in an embodiment showing a state before a wire connecting portion and another constituent component are joined.
Figure 2:
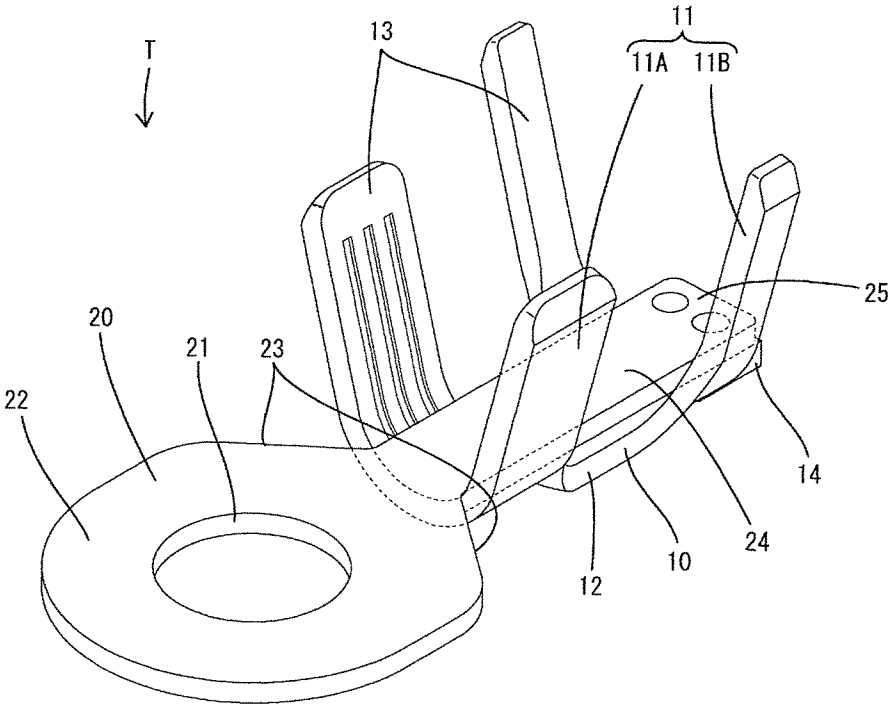
FIG. 2 is a perspective view showing the terminal fitting in a state where the wire connecting portion and the other constituent component are joined.

A terminal fitting T in this embodiment, as shown in FIG. 1, has a wire connecting portion 10 to be connected to an end part of a wire 30 and a separately formed other constituent component 20 to be arranged in front of the wire connecting portion 10. The wire connecting portion 10 and the other constituent component 20 are formed by press-working a suitable metal plate material. In the following description, a left-front side (connection side to a mating side) and a right-back side (connection side to the wire 30) of FIG. 2 are referred to as a front and a rear and upper and lower sides of FIG. 2 are referred to as upper and lower sides in each constituent member.

The wire connecting portion 10 includes a barrel 11 to be crimped to the end part of the wire 30. The barrel 11 is of an open barrel with crimping pieces 13 standing up from a bottom portion 12.

The barrel 11 includes a wire barrel 11A to be crimped to an exposed core 31 and an insulation barrel 11B to be crimped to an end part of an insulation coating 32. The crimping pieces 13 of the wire barrel 11A and the crimping pieces 13 of the insulation barrels 11B are respectively crimped to wrap around the core 31 and the insulation coating 32 of the wire 30. Note that the wire barrel 11A is in front of the insulation barrel 11B.

The wire connecting portion 10 has a wire connection side joint portion 14 to which the other constituent component 20 is to be joined and that projects rearward of the insulation barrel 11B. The wire connection side joint portion 14 is formed by causing the bottom portion 12 of the insulation barrel 11B to project rearward and has a rectangular shape slightly longer in a width direction in a plan view (see FIG. 8).

Figure 3:
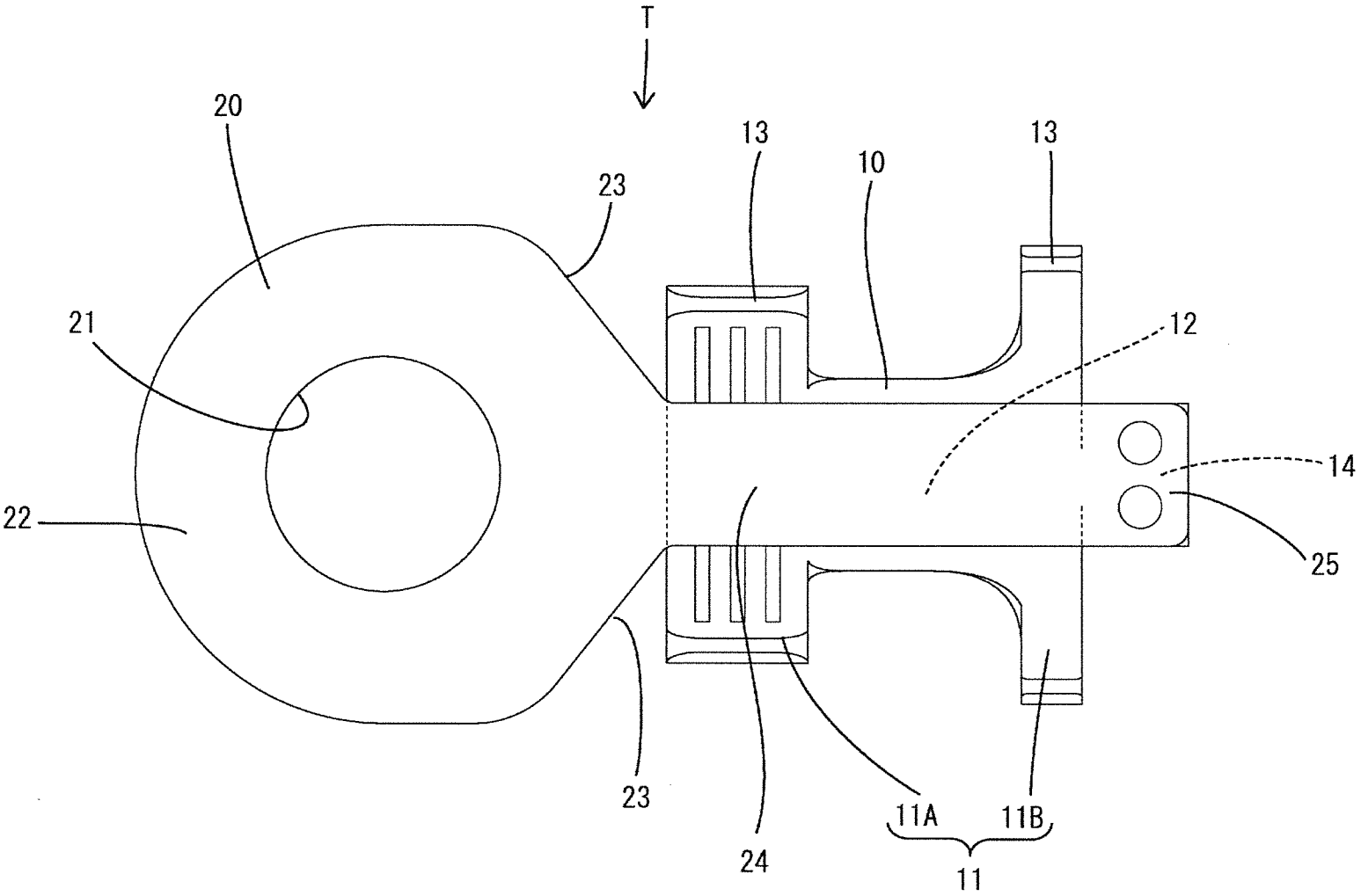
FIG. 3 is a plan view showing the terminal fitting in the state where the wire connecting portion and the other constituent component are joined.

The other constituent component 20 includes a connecting body 22 having a bolt insertion hole 21 for bolting the constituent component 20 to a ground part. The connecting body 22 is in the form of a substantially circular annular flat plate with the substantially circular bolt insertion hole 21 formed in a central part. The rear edge of the connecting body 22 is formed into inclined edges 23 gradually inclined toward a rear end to narrow a width of the connecting body 22, as shown in FIG. 3.

The other constituent component 20 has a joint piece 24 to be overlapped on the wire connecting portion 10 and joined to extend rearward from the rear end of the connecting body 22. The joint piece 24 is integral with the connecting body 22 and extends rearward from a widthwise central part (between a pair of the inclined edges 23) of the connecting body 22. The joint piece 24 is in the form of a substantially rectangular flat plate long and narrow in a front-rear direction. The entire other constituent component 20 including the joint piece 24 is in the form of a flat plate having no step.

A length (dimension in the front-rear direction) of the joint piece 24 is equivalent to a length of the wire connecting portion 10 including the wire connection side joint portion 14 (entire length of the wire connecting portion 10). Further, a width of the joint piece 24 is smaller than a diameter of the bolt insertion hole 21 and equivalent to a width of the bottom portion 12 of the wire connecting portion 10.

An extending rear end part of the joint piece 24 serves as a joint portion to be overlapped on the wire connection side joint portion 14 and joined to form another component side joint portion 25 when the other constituent component 20 is overlapped on the wire connecting portion 10. The other component side joint portion 25 has substantially the same shape as the wire connection side joint portion 14.

Next, examples of an operation of manufacturing the terminal fitting T as described above and an operation of manufacturing the wire 30 with the terminal fitting by connecting the terminal fitting T to the end part of the wire 30 are described.

First, each of the wire connecting portion 10 and the other constituent component 20 is formed of an optimal material into an optimal shape. At this time, by using different materials for the wire connecting portion 10 and the other constituent component 20, material cost can be suppressed. For example, the wire connecting portion 10 may be formed of copper or copper alloy and the other constituent component 20 may be formed of iron or iron alloy, which is a material less expensive than copper. Thus, material cost can be suppressed as compared to the case where the terminal fitting T is formed entirely of copper or copper alloy.

Further, by forming the wire connecting portion 10 of aluminum or aluminum alloy, it is possible to make electrolytic corrosion less likely to occur in the case of connection to the wire 30 in which the core 31 made of aluminum or aluminum alloy is covered with the insulation coating 32 (so-called aluminum wire). Forming the other constituent component 20 of iron or iron alloy, which is harder than aluminum, enables performance withstanding bolting to be provided. Further, a potential difference between iron and aluminum is smaller than that between iron and copper. Thus, electrolytic corrosion is less likely to occur even upon contact with aluminum or aluminum alloy.

Furthermore, by appropriately changing the plate thickness and shape of the wire connecting portion 10, the wire connecting portion 10 can be crimped optimally to wires 30 having large diameters and wires 30 having small diameters. For example, for a wire 30 having a small diameter, a relatively thin plate material is used, the width of the bottom portion 12 is narrowed to conform to the diameter of the wire 30 and the crimping pieces 13 are made smaller to ensure high connection quality. Further, less material is wasted by making the wire connecting portion 10 smaller in accordance with the diameter. For a wire 30 having a large diameter, a relatively thick plate material is used, the width of the bottom portion 12 is expanded to conform to the diameter and the crimping pieces 13 are made larger so that high connection quality can be ensured. The plate thickness and shape of the other constituent component 20 can be set regardless of the wire connecting portion 10 to ensure the plate thickness and the shape necessary for bolting. Thus, connection quality both to the wire 30 and to the ground part can be enhanced.

Next, the wire connecting portion 10 and the other constituent component 20 are joined.

First, as shown in FIGS. 1 and 2, the other constituent component 20 is overlapped on an upper surface side of the wire connecting portion 10. The joint piece 24 of the other constituent component 20 is overlapped on the upper surface of the wire connecting portion 10 (bottom portion 12 of the barrel 11). Then, the front end of the wire connecting portion 10 (front end of the wire barrel 11A) comes into contact with the inclined edges 23 of the connecting body 22 to be positioned in the front-rear direction (see FIG. 2). Further, the rear end of the other constituent component 20 and that of the wire connecting portion 10 are aligned, and the other component side joint portion 25 and the wire connection side joint portion 14 are overlapped entirely (see FIG. 3). Then, the other component side joint portion 25 and the wire connection side joint portion 14 are joined by welding. In this way, the wire connecting portion 10 and the other constituent component 20 are integrated to complete the manufacturing operation of the terminal fitting T.

Figure 4:
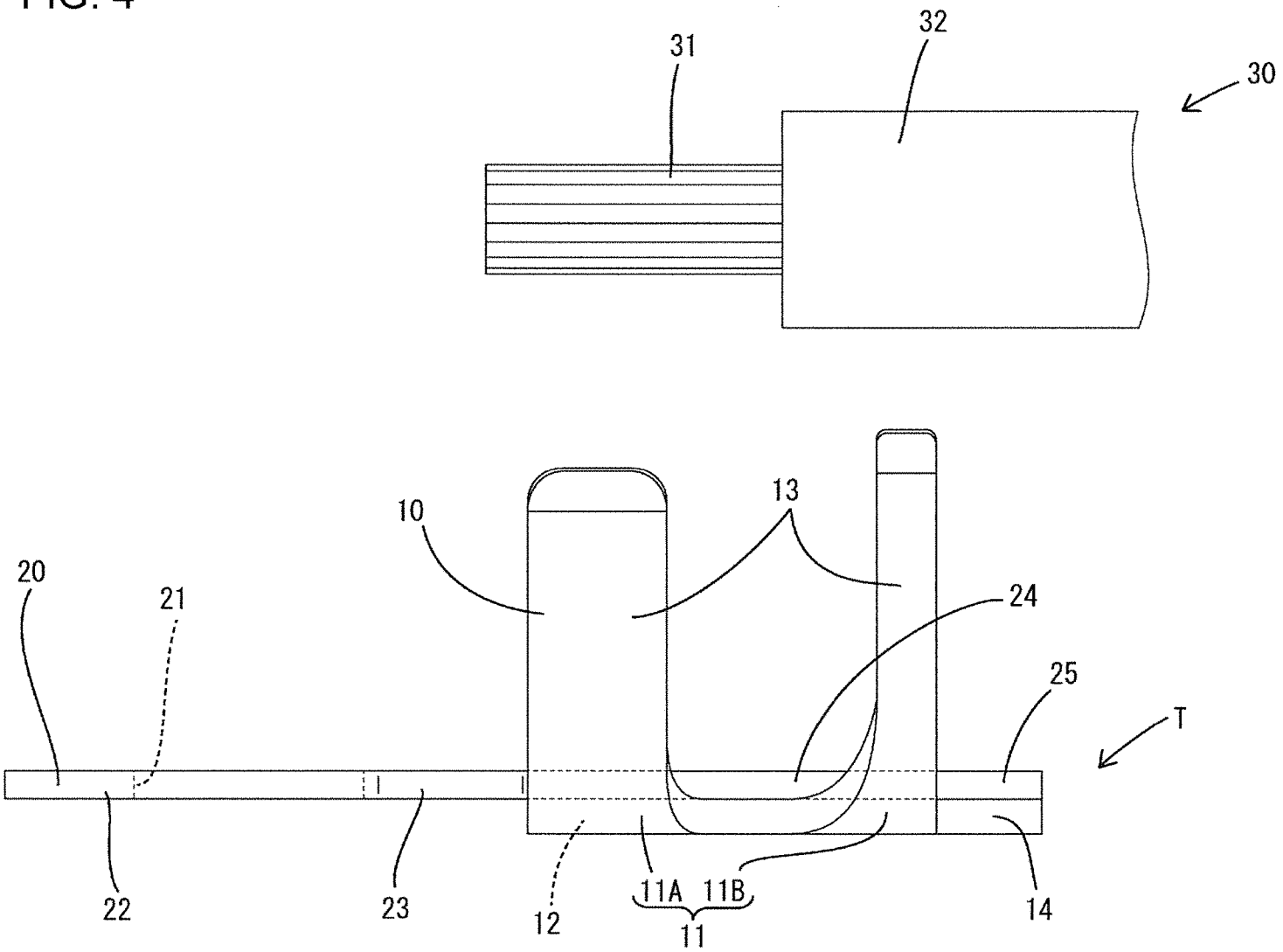
FIG. 4 is a side view showing a state of connecting the terminal fitting to an end part of a wire.
Figure 5:
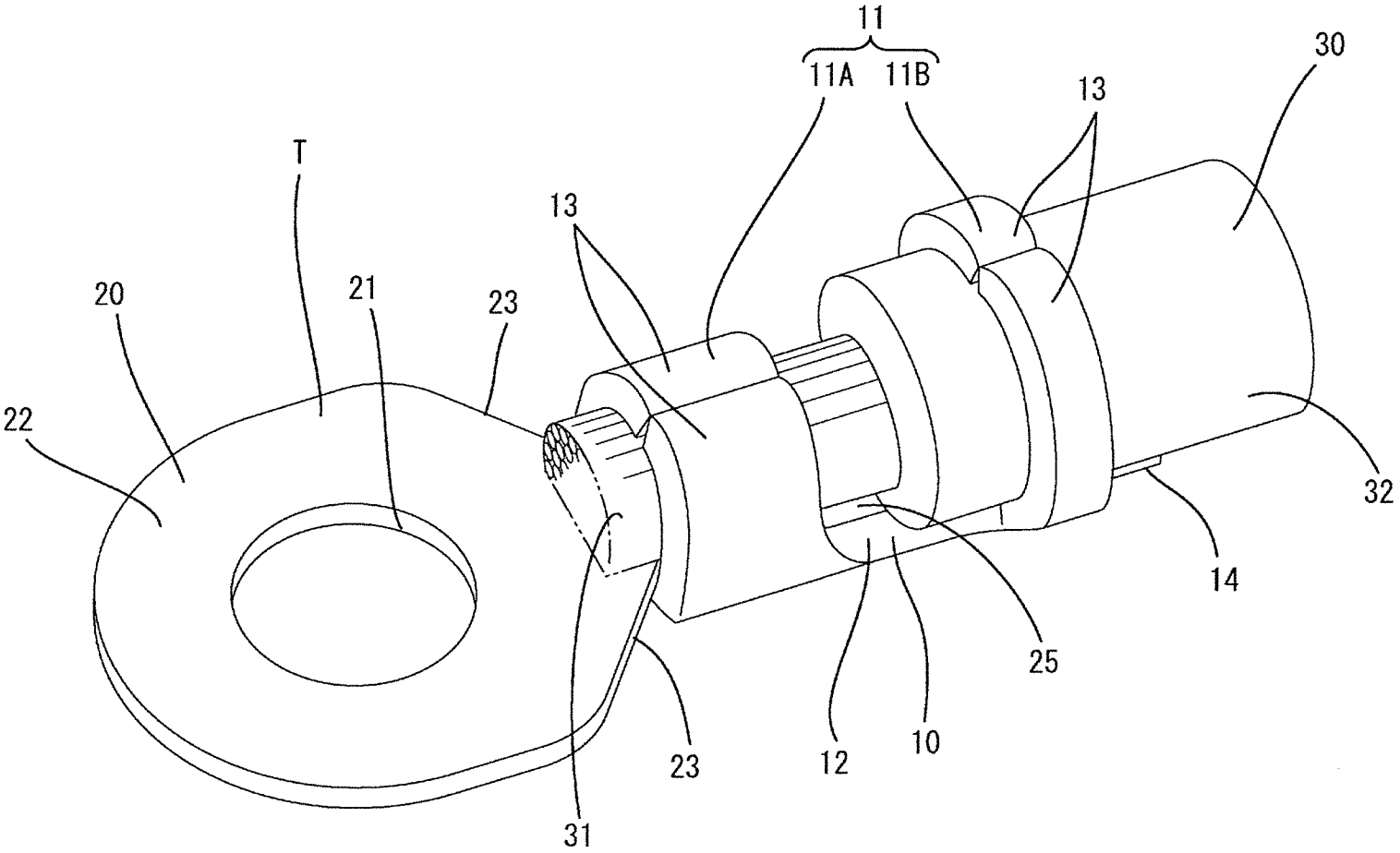
FIG. 5 is a perspective view showing a state where the terminal fitting is connected to the end part of the wire.
Figure 6:
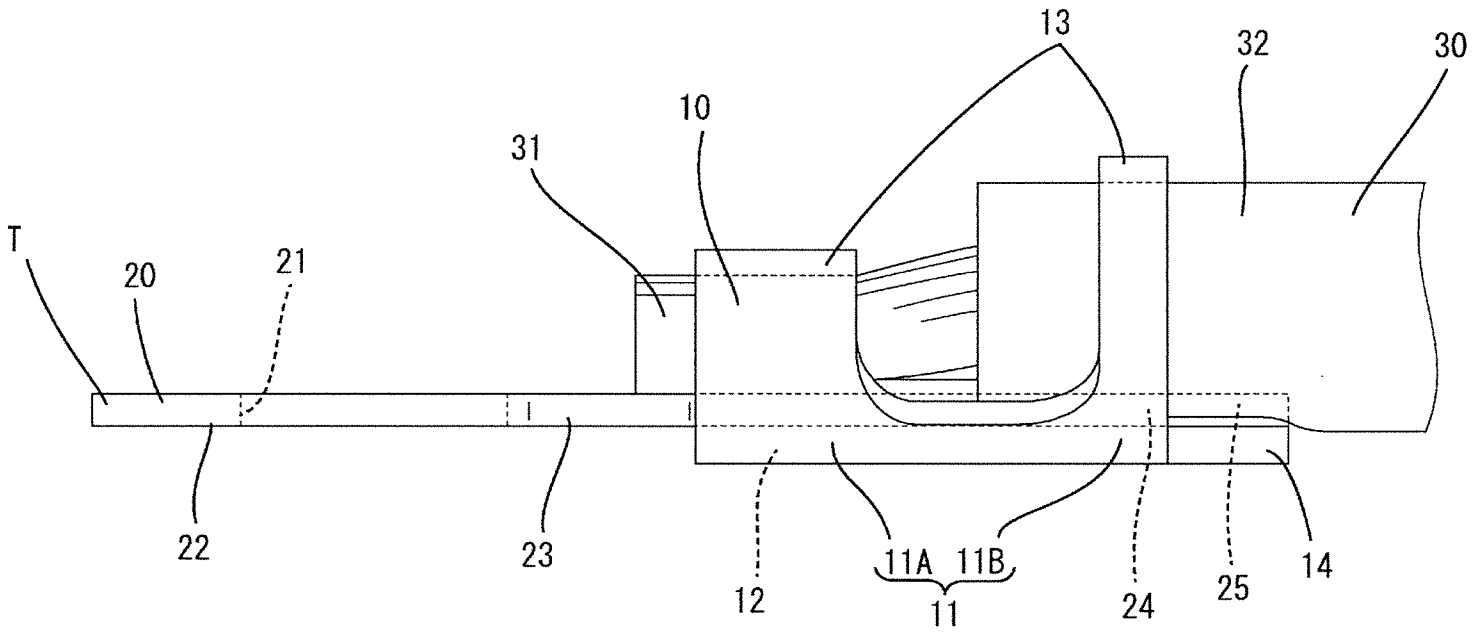
FIG. 6 is a side view showing the state where the terminal fitting is connected to the end part of the wire.
Figure 7:
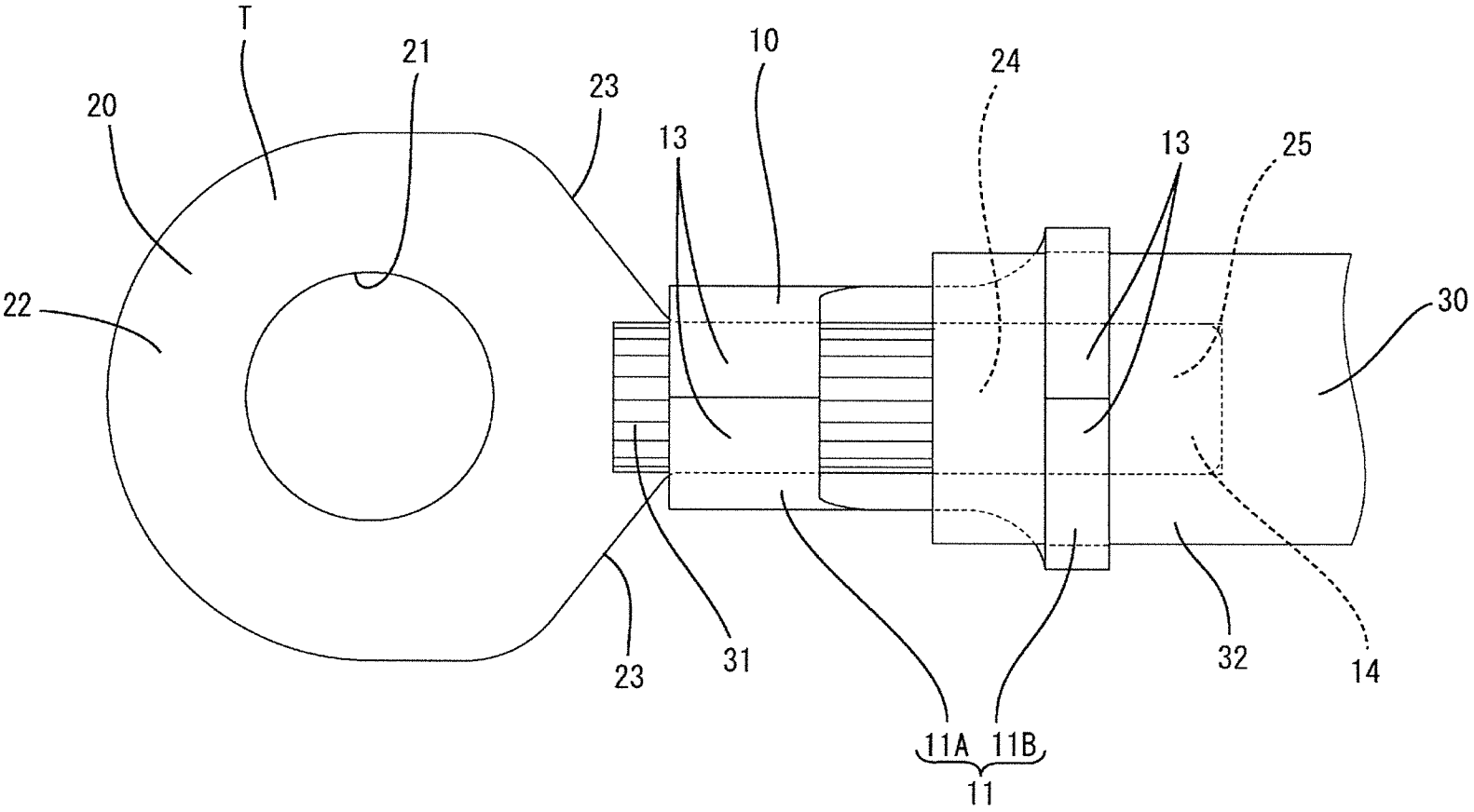
FIG. 7 is a plan view showing the state where the terminal fitting is connected to the end part of the wire.
Figure 8:
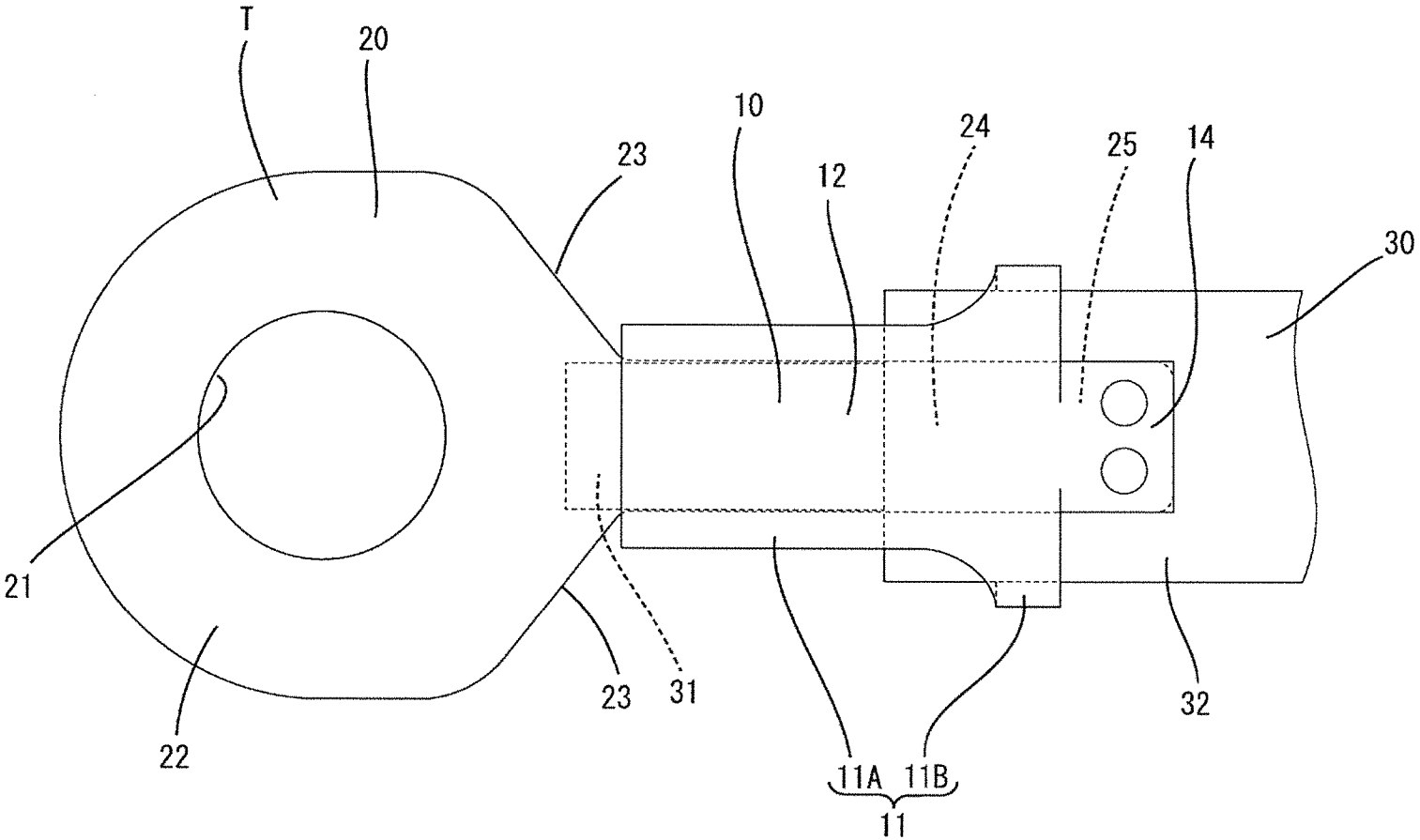
FIG. 8 is a bottom view showing the state where the terminal fitting is connected to the end part of the wire.

Subsequently, as shown in FIGS. 4 and 5, the terminal fitting T is connected to the end part of the wire 30. The end part of the wire 30 is set on an upper surface of the terminal fitting T. Specifically, the end part of the wire 30 is placed on an upper side of the joint piece 24 so that the core 31 exposed at the end part of the wire 30 is located in the wire barrel 11A and the insulation coating 32 is located in the insulation barrel 11B. The crimping pieces 13 of the wire barrel 11A and the crimping pieces 13 of the insulation barrel 11B are crimped so that the crimping pieces 13 enclose the core 31 and the insulation coating 32 together with the joint piece 24 so that the wire barrel 11A is crimped to the core 31 and the insulation barrel 11B is crimped to the insulation coating 32.

In the above way, the manufacturing operation of the wire 30 with terminal fitting is completed. Then, this terminal fitting T is connected, for example, to a predetermined ground part on a body of an automotive vehicle by bolting. In the terminal fitting T bolted to the ground part, the joint portions of the wire connecting portion 10 and the other constituent component 20 are arranged on a side of the wire 30 near the ground part.

The terminal fitting T of this embodiment includes the wire connecting portion 10 to be connected to the end part of the wire 30 and the other constituent component 20 formed separately from the wire connecting portion 10 and to be arranged in front of the wire connecting portion 10, the other constituent component 20 includes the joint piece 24 to be overlapped on the wire connecting portion 10 and joined, and a part of the wire connecting portion 10 behind the part to be crimped to the core 31 of the wire 30 is joined to the joint piece 24. According to this configuration, the joint portions of the wire connecting portion 10 and the other constituent component 20 are arranged along the wire 30. Thus, the joint portions vibrate together with the wire 30, and it is possible to prevent a large force from acting on the joint portions of the wire connecting portion 10 and the other constituent component 20.

Further, the wire connecting portion 10 includes the barrel 11 to be crimped to the end part of the wire 30 and is provided with the wire connection side joint portion 14 (part to be joined to the joint piece 24) projecting rearward of the barrel 11. According to this configuration, the joint portions of the wire connecting portion 10 and the other constituent component 20 are displaced rearward of the barrel 11, the influence of the deformation of the barrel 11 on the joint portions when the barrel 11 is crimped can be reduced.

Further, the barrel 11 is crimped to the end part of the wire 30 arranged on the upper surface. Additionally, the joint piece 24 is overlapped on the upper side of the bottom portion 12 of the barrel 11 and joined. According to this configuration, since the barrel 11 is crimped to the joint piece 24 together with the wire 30, a force acting on the joint portions can be reduced.

Further, the wire connecting portion 10 and the other constituent component 20 are joined by welding. According to this configuration, the structures of the joint portions can be simplified, for example, as compared to the case where joint portions provided with crimping pieces are joined.

Further, the other constituent component 20 includes the connecting body 22 having the bolt insertion hole 21 for bolting to the ground part. According to this configuration, in the terminal fitting bolted to the ground part, the joint portions of the wire connecting portion 10 and the other constituent component 20 are arranged on the ground part side. Since the wire 30 is hardly bent toward the ground part side (joint portion side), a force acting on the joint portions can be reduced.

The invention is not limited to the above described and illustrated embodiment. For example, the following embodiments also are included in the scope of the invention.

Although the barrel 11 of the wire connecting portion 10 is of the open barrel type in the above embodiment, there is no limitation to this. For example, the barrel of the wire connecting portion may be of a closed barrel type.

Although the wire connecting portion 10 includes the barrel 11 to be crimped to the end part of the wire 30 in the above embodiment, there is no limitation to this. For example, the wire connecting portion may include an insulation displacement blade with which the core of the wire is to be pressed into contact.

Although the wire connecting portion 10 is provided with the wire connection side joint portion 14 and the joint piece 24 is joined behind the barrel 11 in the above embodiment, there is no limitation to this. The joint piece has only to be joined to a part of the wire connecting portion behind the part to be crimped to the core of the wire. For example, the joint piece of the other constituent component may be joined to the bottom portion of the insulation barrel without providing the wire connection side joint portion.

Although the joint piece 24 is overlapped on the upper side of the bottom portion 12 of the barrel 11 and joined in the above embodiment, there is no limitation to this and the joint piece may be overlapped on a lower side of the bottom portion of the barrel and joined.

Although the wire connecting portion 10 and the other constituent component 20 are joined by welding in the above embodiment, there is no limitation to this. For example, the joint portions may be provided with crimping pieces and joined or crimping by the crimping pieces may be performed in addition to welding.

Although the other constituent component 20 includes the connecting body 22 having the bolt insertion hole 21 for bolting to the ground part in the above embodiment, there is no limitation to this and the other constituent component may be in any form provided that the other constituent component is to be arranged in front of the wire connecting portion. For example, the other constituent component may be a female-side tubular connecting portion into which a tab of a mating terminal fitting is to be inserted and connected, a male-side connecting portion that includes a tab, or the like.

Although the other component side joint portion 25 and the wire connection side joint portion 14 are joined by welding in the above embodiment, welded parts are not limited to these and welding may be performed in a wider range where the joint piece and the wire connecting portion are overlapped.

LIST OF REFERENCE SIGNS

T . . . terminal fitting
10 . . . wire connecting portion
11 . . . barrel
12 . . . bottom portion
14 . . . wire connection side joint portion
20 . . . another constituent component
21 . . . bolt insertion hole
22 . . . connecting body
24 . . . joint piece
30 . . . wire
31 . . . core

The invention claimed is:

1. A terminal fitting, comprising:

a wire connecting portion to be connected to an end part of a wire, the wire connecting portion having a barrel formed with a base plate extending in a forward to backwards direction and first and second side edges extending in the forward and backward directions, a distance between the first and second side edges defining a base plate width dimension, and at least one pair of first and second crimping portions to be crimped to the wire standing up from the first and second side edges of the base plate respectively at positions facing one another; and another constituent component formed separately from the wire connecting portion and arranged in front of the wire connecting portion, the other constituent component having a connecting body extending in the forward to backward direction, a rear end of the connecting body narrowing in the forward to backward direction to define inclined edges, and a joint piece extending backwards from the rear end of the connecting body, the joint piece having a width dimension normal to an extending direction of the joint piece, wherein:

the joint piece overlays the base plate of the wire connecting portion and is joined thereto at a proper mounting position;

the inclined edges of the connecting body contact the at least one pair of first and second crimping portions to prevent the wire connecting portion from being mounted at a position forward of the proper mounting position; and the width of the joint piece is not greater than the width of the base plate.

2. The terminal fitting of claim 1, wherein:

the at least one pair of first and second crimping portions is crimped to the end part of the wire arranged on an upper surface side thereof.

3. The terminal fitting of claim 1, wherein the wire connecting portion and the other constituent component are joined by welding.

4. The terminal fitting of claim 1, wherein the connecting body includes a bolt insertion hole for bolting to a ground part.

* * * * *